US006196635B1

(12) United States Patent
Rohaly et al.

(10) Patent No.: US 6,196,635 B1
(45) Date of Patent: Mar. 6, 2001

(54) METHOD OF INSTALLATION OF CUTTABLE MINE SUPPORT

(75) Inventors: A. J. Rohaly, Lexington; Peter S. Mills, Stamping Ground, both of KY (US)

(73) Assignee: Fosroc International Limited, Wiltshire (GB)

( * ) Notice: Subject to any disclaimer, the term of this patent is extended or adjusted under 35 U.S.C. 154(b) by 0 days.

(21) Appl. No.: 09/249,788

(22) Filed: Feb. 16, 1999

Related U.S. Application Data

(60) Provisional application No. 60/074,940, filed on Feb. 17, 1998.

(51) Int. Cl.[7] ..... E21D 15/00

(52) U.S. Cl. ..... 299/11; 405/287.1; 405/272; 405/288

(58) Field of Search ..... 299/11; 405/287.1, 405/272, 288

(56) References Cited

U.S. PATENT DOCUMENTS

| | | | | |
|---|---|---|---|---|
| 4,277,204 | * | 7/1981 | Koppers et al. | 405/288 |
| 4,770,564 | * | 9/1988 | Dison | 405/288 |
| 4,983,077 | * | 1/1991 | Sorge et al. | 405/288 |
| 5,288,178 | | 2/1994 | Pienaar | 405/288 |
| 5,427,476 | | 6/1995 | Pienaar et al. | 405/288 |
| 5,435,670 | | 7/1995 | Pienaar et al. | 405/288 |

FOREIGN PATENT DOCUMENTS

90/1210 2/1990 (ZA) .

* cited by examiner

*Primary Examiner*—David Bagnell
*Assistant Examiner*—John Kreck
(74) *Attorney, Agent, or Firm*—Nixon & Vanderhye P.C.

(57) ABSTRACT

A method and apparatus are provided for installing a mine support (pillar, or pillar and grout bag) in a mine. The following are practiced: Locating a form in the mine where it is desired to provide support, the form being composed of a plurality of engaging parts shaped to produce a pillar when filled with a settable material, and the parts being disengageable to permit subsequent removal. Filling the form with a settable cementitous material and allowing the material to set to produce a pillar in the mine which is cuttable with a coal shearer. And, removing the form. When there is a gap between the top of the pillar and the roof of the mine a bag of yieldable grout is inserted in the gap. After use the support may be removed by cutting through the pillar and the bag of yieldable material, and the form may be reused to make a second pillar.

6 Claims, 10 Drawing Sheets

FIG. 5
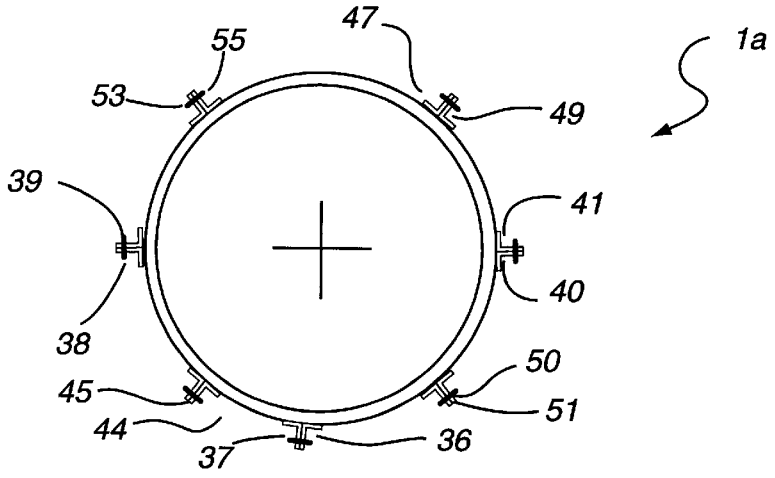
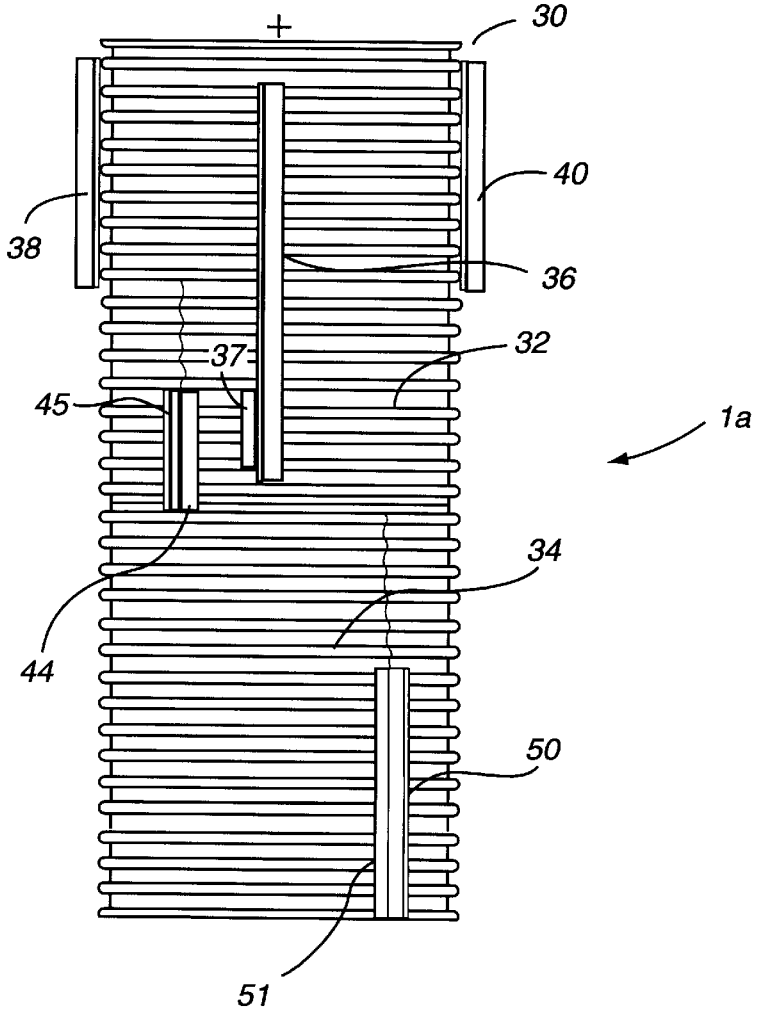
FIG. 4

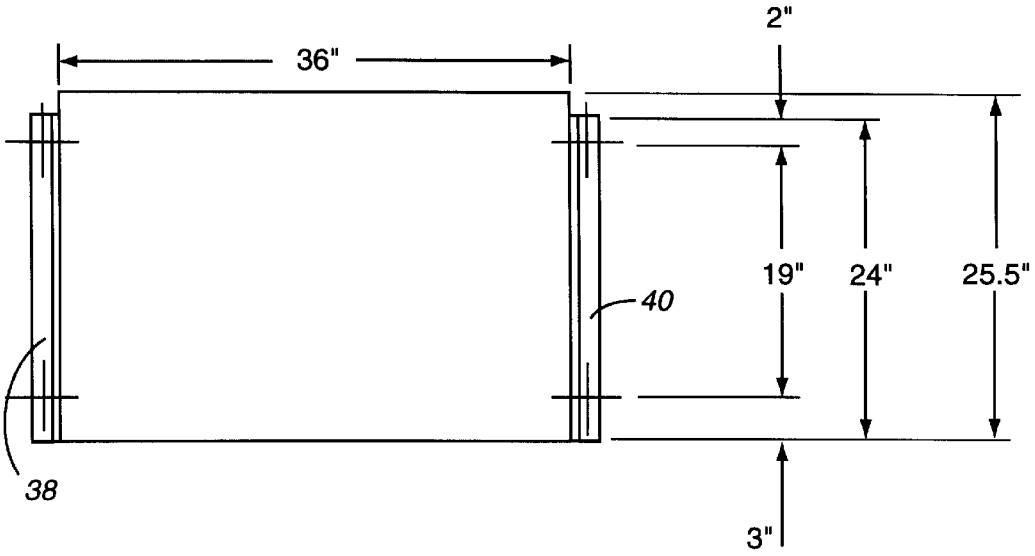
FIG. 6
FIG. 7
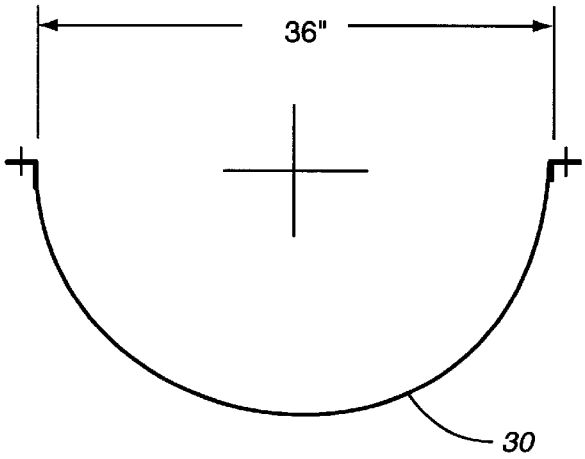
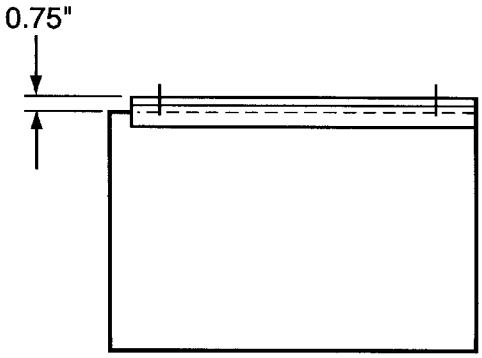
FIG. 8

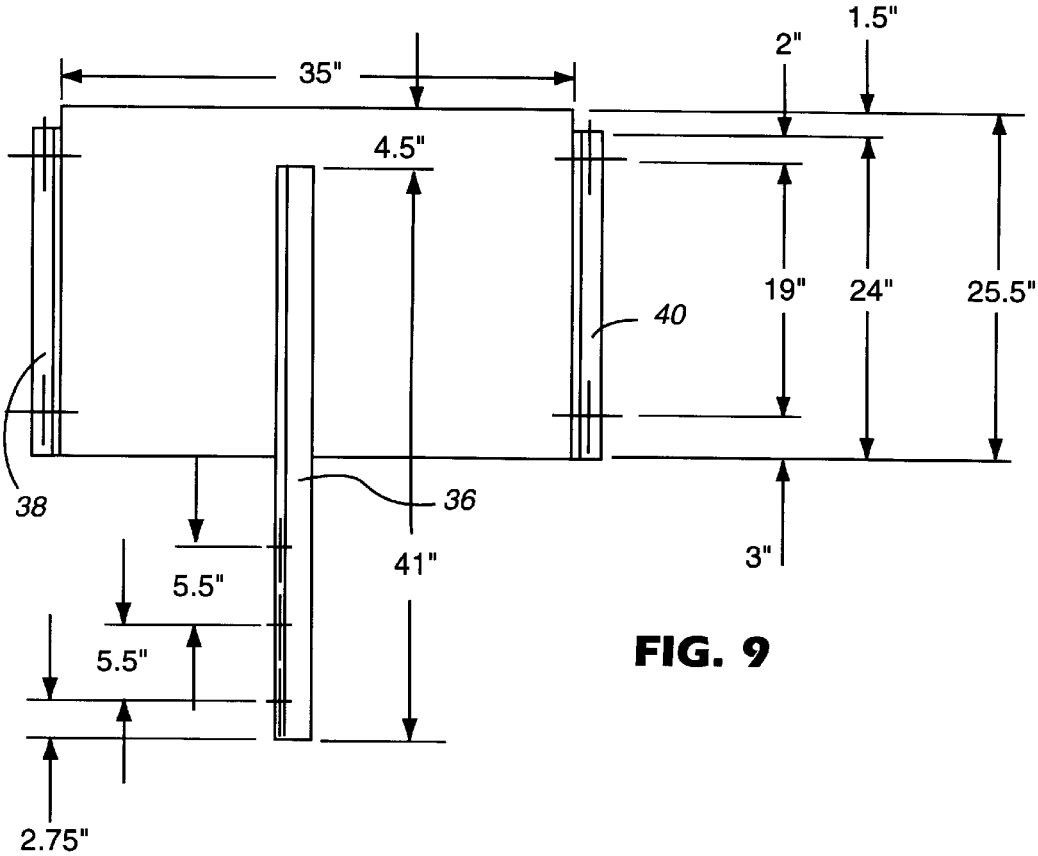
FIG. 9
FIG. 10
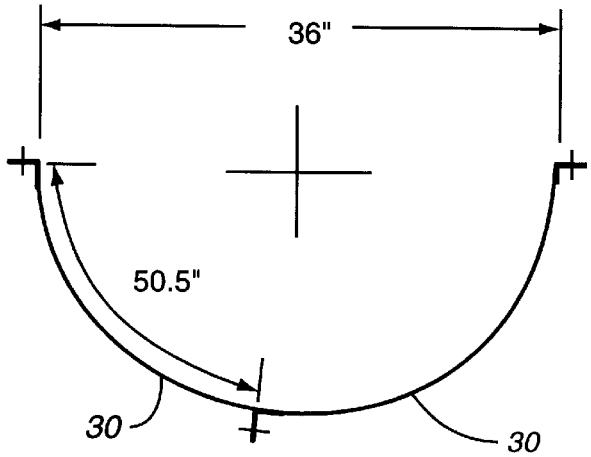
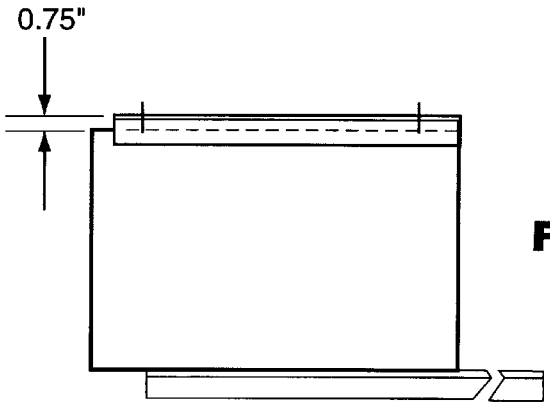
FIG. 11

METHOD OF INSTALLATION OF CUTTABLE MINE SUPPORT

CROSS-REFERENCE TO RELATED APPLICATION

This application is based upon provisional application Ser. No. 60/074,940 filed Feb. 17, 1998.

BACKGROUND AND SUMMARY OF THE INVENTION

This invention relates to a mine support, to a method of installing the mine support in a mine and removing the support therefrom and also to a pack of components for carrying out the method.

In the mining of coal in the U.S.A. the availablility of increasingly powerful retreat longwall equipment has led to wider and longer longwall panels. Panels greater than 10,000 feet in length and 1,200 feet in width are not uncommon. As gateroads become longer, the rate at which they are mined becomes ever more important. Delays in gateroad mining have caused significant longwall system downtime. In addition the pressure necessary to ventilate the longwall working increases. In an effort to reduce both the gateroad mining time and longwall ventilation pressures, longwall operators mine cut-through entries across the longwall panels in advance of the face. Some longwall mines cut a recovery room entry across the panel at its endpoint to facilitate the removal of longwall equipment. Both cut-through and recovery room entries must be supported with mineable supports to prevent falls of immediate roof in advance of the face. Previously, cut-through and recovery room entries were filled with cement pillars topped with yielding wood cribs or were fully hydraulically backfilled.

The cement pillars have been cast using forms made of cardboard known in the art as Sonotubes. These forms which are cylindrical in shape are therefore bulky and inconvenient to take into the mine from the surface.

A further problem is that the wooden yielding element is difficult to cut using a coal shearer and has on occasions been found to jam the coal face conveyor.

When the entire entries are hydraulically backfilled there is a huge additional burden on the coal preparation plant which separates the waste product from the coal.

The present invention avoids these problems by the provision of a mine support in which the wooden yielding element is replaced with a bag of yieldable grout which bag of grout is cuttable by a coal shearer.

According to the present invention a cuttable mine support is provided comprising (i), a cementitious pillar and (ii) a bag containing a yieldable grout interposed between the top of the pillar and the roof of the mine and wherein said cementitious pillar and bag of yieldable grout are cuttable with a coal shearer.

The cementitious pillar and bag of yieldable grout are both cuttable by a coal shearer and the support of the present invention therefore avoids the problems associated with backfilling or the use of wooden cribs mentioned above.

By the term cuttable we mean that the pillar and the bag of grout may be cut right through by means of a coal shearer, an example of which is a double ended ranging drum shearer made by Joy Technologies Inc.

By cementitous we mean having the property of setting by the addition of water and furthermore being hydraulic by which is meant that it can set under water.

The cementitious pillar may be obtained by the addition of water to a large range of cementitious materials e.g. Portland cement, blast furnace slag and Class C flyash and mixtures thereof.

Other materials such as waste mine tailings, cement kiln dust, crushed rock, Class F flyash or other type of cheap filler that can be made into a hydraulically setting pumpable grout may be used. On the grounds of cost and availablility Class F flyash is usually preferred.

Flyash is defined in Standard Specification C 618 of the American Society for Testing Materials (ASTM) as "finely divided residue that results from the combustion of ground or powdered coal". ASTM C 618 defines two distinct types of flyash, Class F and Class C, the former (obtained by the combustion of anthracite or bituminous coal ) being more common than the latter (obtained by the combustion of sub-bituminous coal or lignite). One characteristic of Class C flyash is its higher calcium content, expressed as lime content and stated by ASTM C618 to be often higher than 10% by weight.

Class C flyash, unless containing a retarder, is inconveniently fast setting and it is therefore preferred not to use Class C flyash alone.

A mixture of Class C and Class F may conveniently be used, the proportions of the mixture being adjusted to give a material which is workable for an adequate period of time. In practice this means that the mixture should be fluid and workable from the time it is mixed with water at the surface until it reaches the form located in the mine where the support is to be installed. This will normally be about an hour.

The flyash is preferably mixed with a cementitious material such as Portland cement to improve its strength, for example as described in U.S. Pat. No. 5,536,310.

Suitable flyash-containing compositions are also described in U.S. Pat. Nos. 5,387,283; 5,439,518; 5,435,843; 5,534,058; 4,992,102; 5,4890,889; 5,556,458; and 5,565,028.

The yieldable grout may be a grout as described in GB Patent No 2,058,037A which discloses a grout which comprises by volume 1 to 30% of a cement mixture, 0.001 to 5% clay and water in excess of 65%, the cement mixture comprising Portland cement, 10 to 75% of a mixture of calcium aluminate and calcium sulphate, 0.5 to 15% of an inorganic salt accelerator and 0.005 to 3% of an organic or inorganic set retarder.

Alternatively the yieldable grout may be one as described in GB Patent No 2,123,808A which discloses a grout which forms Ettringite on hardening and which comprises a high alumina cement, beta-anhydrite and calcium oxide and/or hydroxide. These grouts can contain water to cement ratios up to 2.5:1 or higher by weight. The grout may also be as described in U.S. Pat. No 5,454,866 which discloses a grout containing 20 to 80% of Portland cement, 17 to 35% of a high alumina cement, 20 to 40% of anhydrous calcium sulphate a lithium salt as accelerator for the high alumina cement and a strong base as accelerator for the Portland cement.

Suitable grouts are those known in the art as high yield grouts for example those having a ratio by weight of water to solids of at least 1.5:1 usually in the range 2 to 5:1. The large proportion of water confers the property of being able to release water under pressure and provide the ability to yield in the required manner.

A particularly suitable grout is a high yield grout sold under the Trade Name Tekset by Fosroc International Limited.

A high strength foamed cement would also be suitable as the cuttable yieldable material.

The pillar of cement may be cast using a form which is composed of a plurality of separable parts which permit the form to be removed when the pillar has set and leave a pillar which can be cut.

The form is preferably adjustable in height and this may be provided by the form comprising two (or more) tubular pieces each made of corrugated plastic, steel or iron, the pieces being capable of overlapping longitudinally.

According to another aspect of the present invention there is provided a method of installing a mine support comprising: (i) locating in a mine a form where it is desired to provide support for the mine, the form being composed of a plurality of engaging parts shaped to produce a pillar when filled with a settable material, and the parts being disengageable to permit subsequent removal; (ii) filling the form with a settable cementitious material and allowing the cementitious material to set and thereby produce a pillar; and (iii) removing the form to provide a pillar in the mine which is cuttable with a coal shearer.

The form is conveniently lined with a bag which is to receive the settable cementitious material. The purpose of the bag is to act as a seal and confine the cementitious material within the form and facilitate removal of the form after the cementitous material has set.

The bag may be made of a plastics material such as a coated woven polypropylene. It is possible for the bag to be made of a water permeable material which would allow excess water to escape from the cementitious material through the wall of the bag.

A bag containing a yieldable material may be placed between the top of the pillar and the roof of the mine. A suitable yieldable material is Tekset which is a pumpable cement specially adapted for blocking and wedging cribs and posts and for conforming to roof irregularities sold by Fosroc International. Its setting time is normally about 10 to 15 minutes.

The bag is conveniently of the type which is known in the art used for prestressing a crib. Suitable bags are described in U.S. Pat. Nos. 5,427,476 and 5,288,178.

The flyash cement is conveniently pumped from the surface and the Tekset can be mixed and pumped underground or also pumped from the surface.

According to a further aspect of the invention a pack of components for use in providing a mine support is provided, the pack comprising: (i) a plurality of engageable parts for assembly to provide a form to produce a pillar when the assembled form is filled with a settable material, the assembled parts of the form being disengageable to permit removal of the form from the cementitious material when the latter has set; and (ii) a bag to be placed inside the assembled form to receive the settable material.

The pack may also comprise a bag containing a yieldable grout to be interposed between the top of the form and the roof of the mine.

The form used for making the cementitious pillar of the invention is illustrated by the accompanying drawings.

The form is made up of three tubular sections: a top section, a middle section and a bottom section. Each section is composed of two halves thereby making six main pieces altogether. The halves are held together by right angle shaped steel brackets hereafter referred to as angle irons. Further angle irons join the top and middle sections together and allow different degrees of overlap of these sections thereby providing height adjustment.

BRIEF DESCRIPTION OF THE DRAWINGS

FIGS. 1A to 3 illustrate on embodiment of the form and FIGS. 4 to 20 an alternative embodiment;

FIG. 1A is a vertical section through an exemplary tubular form according to the first embodiment of the invention;

FIG. 3 is a perspective exploded view showing a portion of the tubular form of FIGS. 1A and 2A on a larger scale;

FIG. 4 is a side elevation of another embodiment of an assembled form in an upright disposition, and FIG. 5 is a plan view of the form i.e. looking down on the top end;

FIGS. 6, 7 and 8 are views of one half of the top section of the form of FIG. 4, and FIGS. 9, 10 and 11 are views of the second half of the top section (the two halves not being identical);

DETAILED DESCRIPTION OF THE DRAWINGS

Figure 1A:
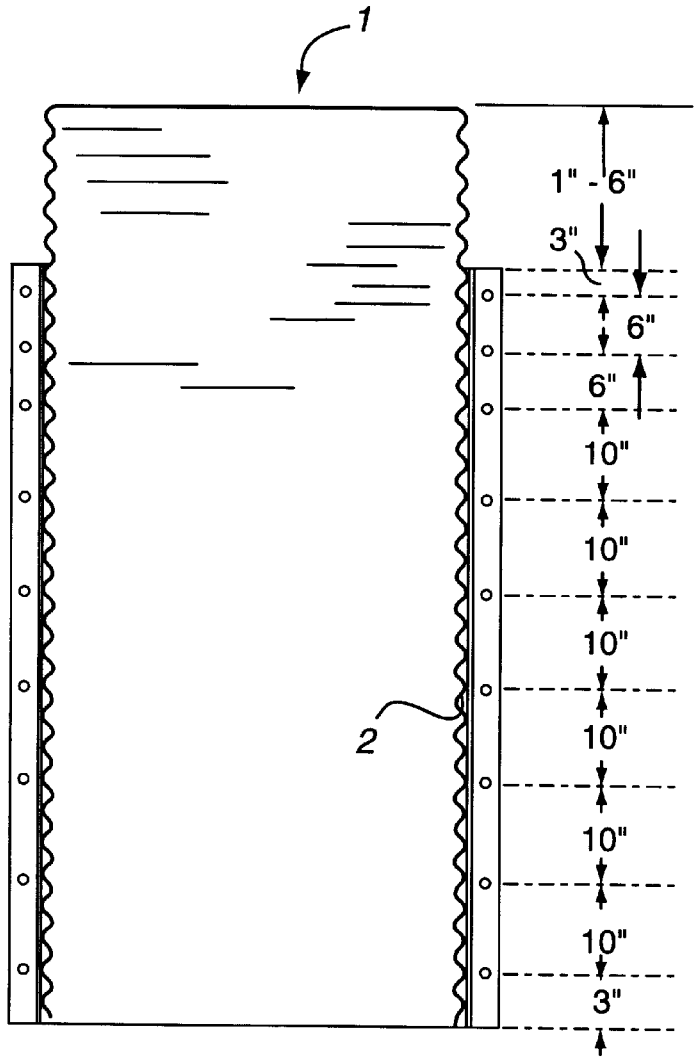
Figure 1B:
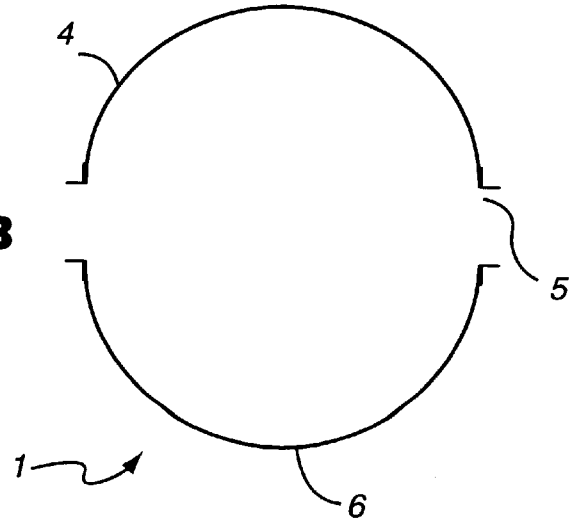
FIGS. 1B and 2B are detailed views of components of the form of FIGS. 1A. and 2A.
Figure 2A:
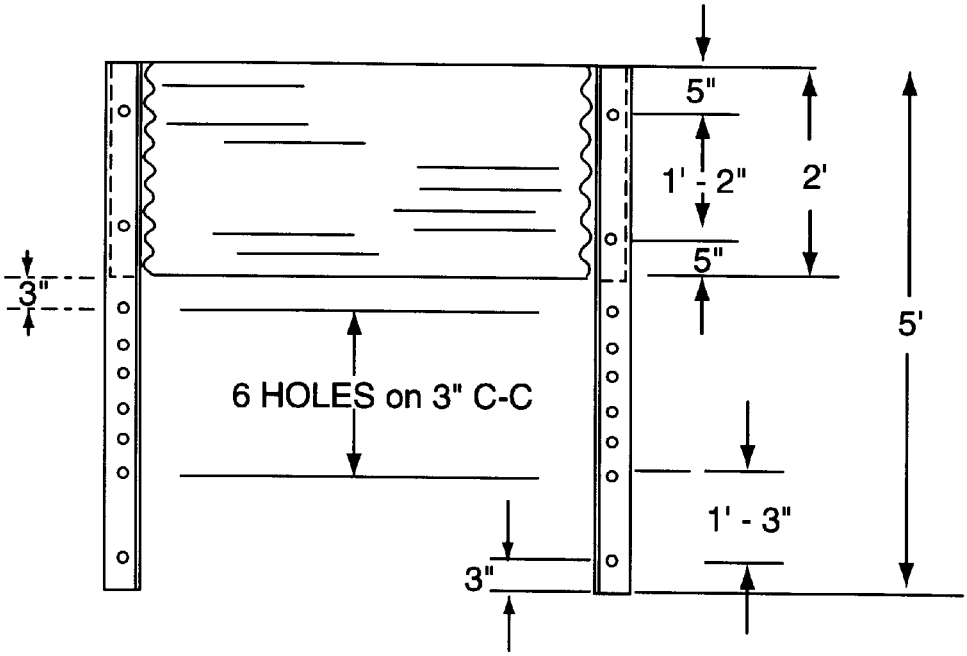
FIG. 2A is another vertical section through the tubular form of FIG. 1A.
Figure 2B:
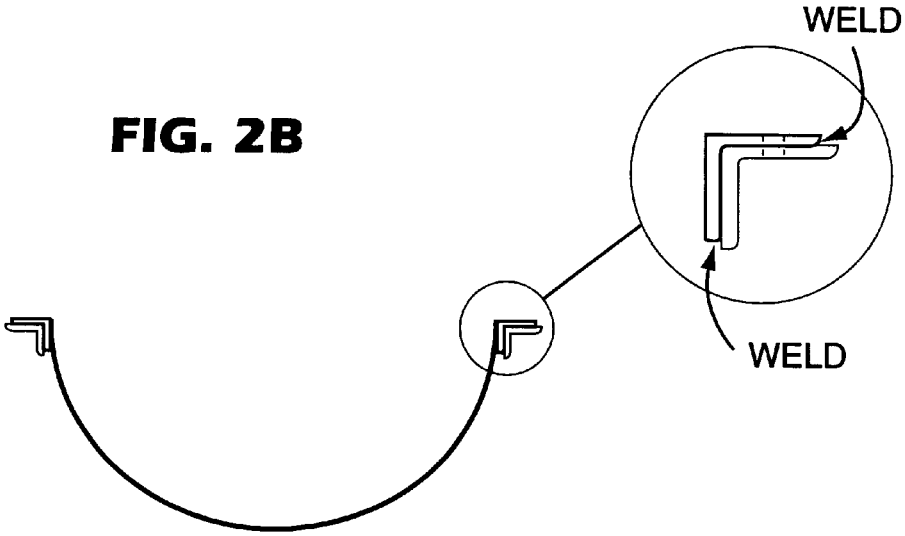
Figure 3:
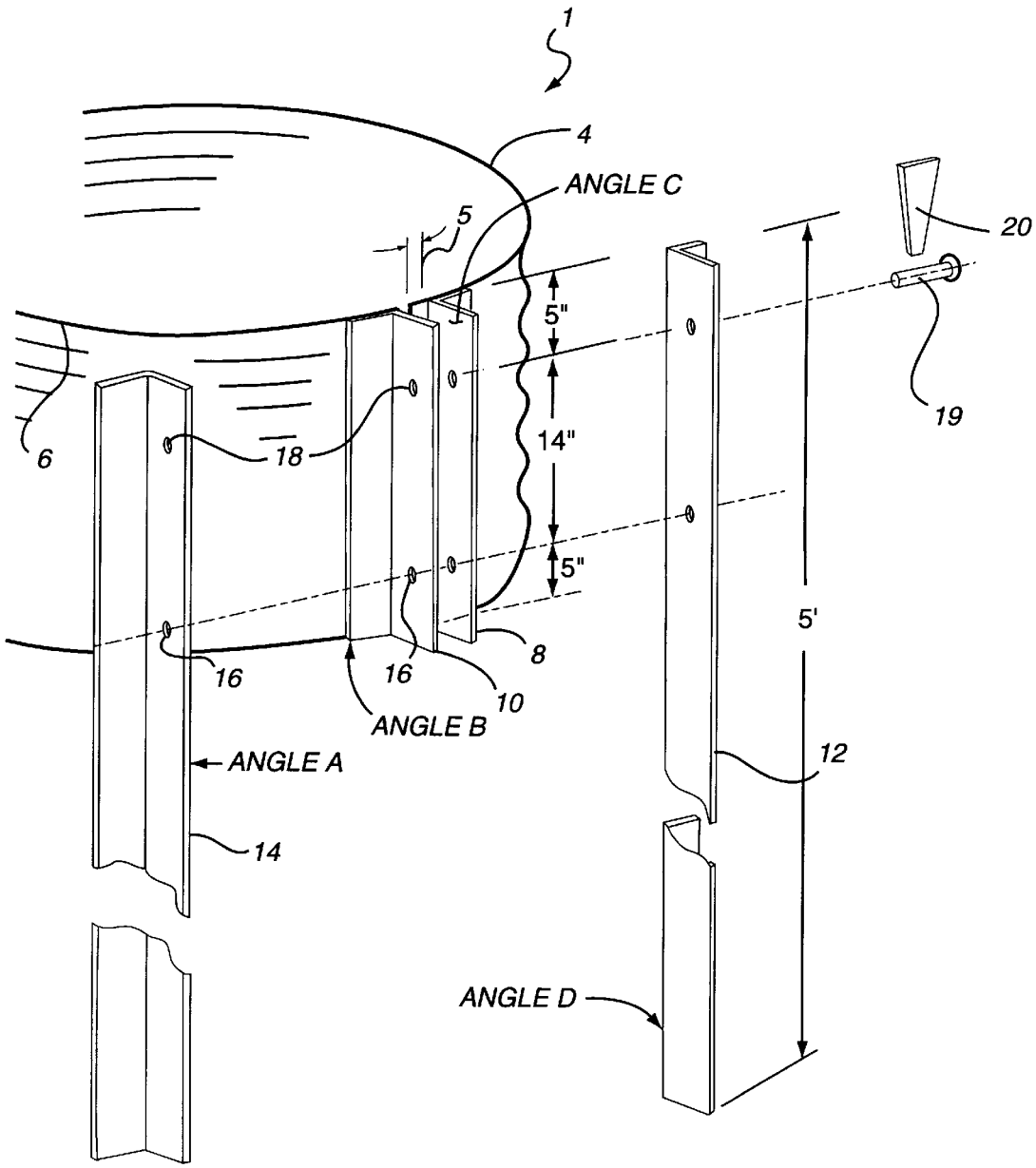
Figure 12:
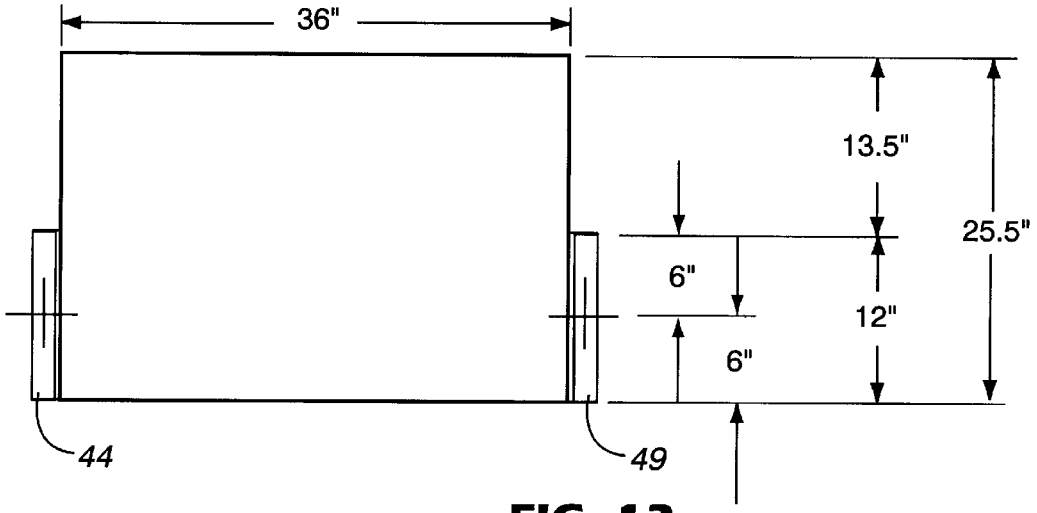
FIGS. 12, 13 and 14 are views of one half of the middle section of the form of FIG. 4, and FIGS. 15, 16 and 17 are views of the second half of the middle section (the two halves again not being identical)
Figure 13:
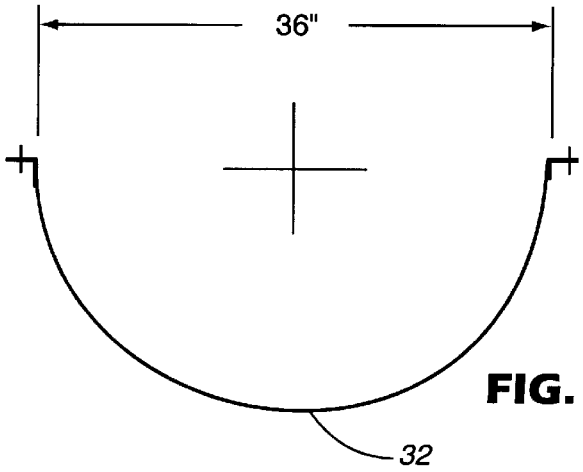
Figure 14:
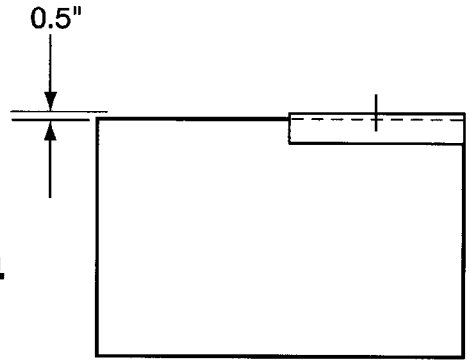
Figure 15:
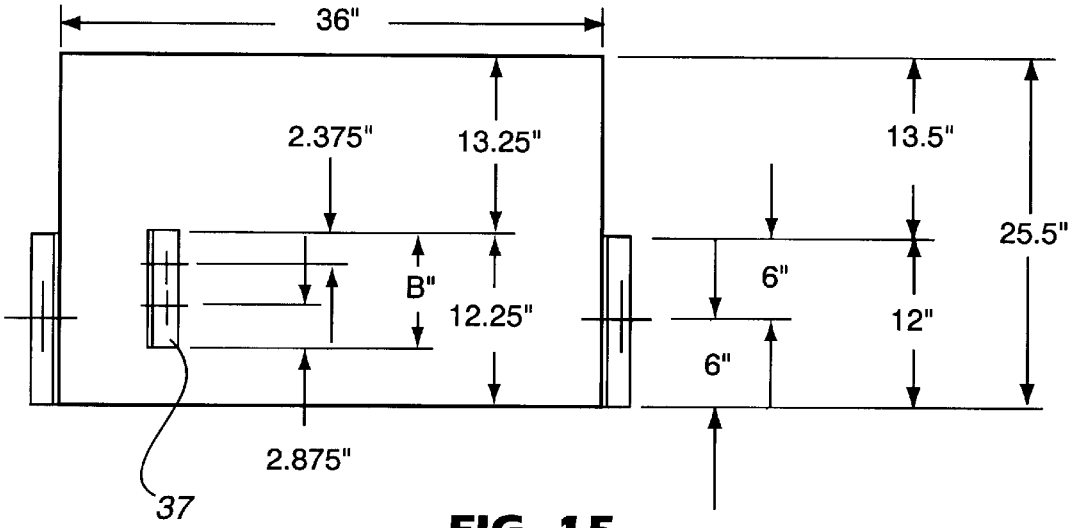
Figure 16:
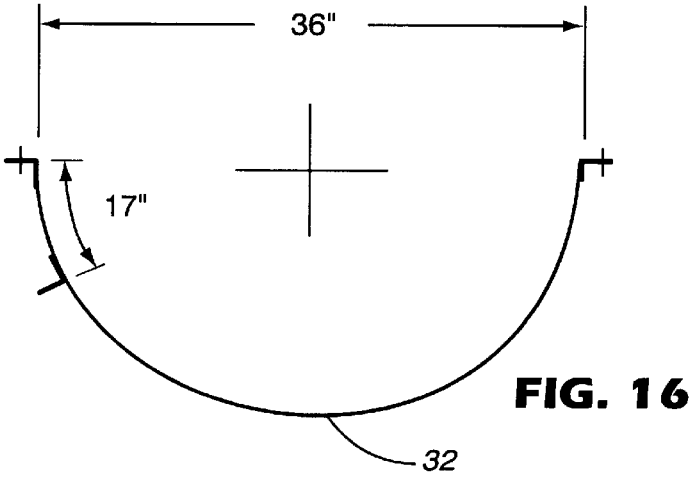
Figure 17:
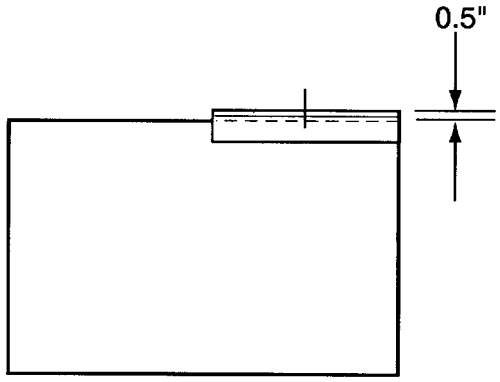

A tubular form indicated generally by numeral 1 (see FIGS. 1A, 1B, and 3 in particular) comprises a corrugated steel tube 2 divided in a vertical plane into two halves 4 and 6. Built into half 4 is a slight overhang 5 which is shown in FIGS. 1B and 3.

Angle irons 8 and 10 are welded to each of the halves 4 and 6 respectively and further angle irons 12 and 14 are welded to the angle irons 8 and 10 respectively. The angle irons have a plurality of holes spaced apart at regular intervals. Slotted pins, only one of which is shown at 19, may be inserted through aligned holes 16 and 18 and held in place by a wedge 20 inserted in the slot (not shown) in the pin 19. Alternatively the wedges themselves may be slotted and can be inserted into each other.

An alternative embodiment of the form is illustrated in FIGS. 4 and 5. FIGS. 6 to 20 show the details of the three sections and the halves of each section making up the form.

The assembled form 1 a shown in FIG. 4 comprises or consists of three sections: a top section 30, middle section 32 and bottom section 34. Each section is made up of two halves which, when the form is assembled and upright, meet in a vertical plane.

Each section 30, 32, 34 utilizes four angle irons to join its respective halves together. The angle irons that come into contact with each other when the halves of any section are joined are mirror images of each other. Similarly the angle iron welded to one side of one half of any section is the mirror image of the angle iron welded to the other side of the same half. As a result each section has two pieces of two different angle irons bringing the total to four, and the angle irons used on either half are identical to those used on the other half.

Angle irons 38 and 40 are welded to one half of the top section 30 and are used to join the two halves together. Angle irons 38 and 40 meet angle irons 39 and 41 respectively. The latter two angle irons are shown in FIG. 5. All the angle irons are similar to those shown in perspective in FIG. 3 and have a plurality of holes (not shown) spaced apart along their length at regular intervals. Wedges similar to those shown in FIG. 3 hold the irons together when their holes are aligned.

An angle iron 36 which is longer than angle irons 38 and 40 is welded to the top section 30 and overlaps but is not welded to middle section 32. Middle section 32 has an angle iron 37 welded thereto which meets angle iron 36 and provides a connection which is adjustable to vary the height of the assembled form.

The two halves of the middle section 32 are joined by angle irons 44 and 45. There are two further angle irons 47 and 49 joining the two halves of the bottom section which are shown in FIG. 5.

The two halves of the bottom section 34 are held together by angle irons 50 and 51 and 53 and 55, the latter two being shown in FIG. 5.

FIGS. 6 to 8 and 9 to 11 gives the dimensions of the top section and the angle irons 36, 38, 39, 40 and 41. It can be seen that angle iron 40 is offset by 0.75 inches (shown FIG. 8).

FIGS. 12 to 14 and 15 to 17 give the dimensions of the middle section 32 and the angle irons 44, 45, 47 and 49 and show that the angle irons are offset by 0.5 inches.

Figure 18:
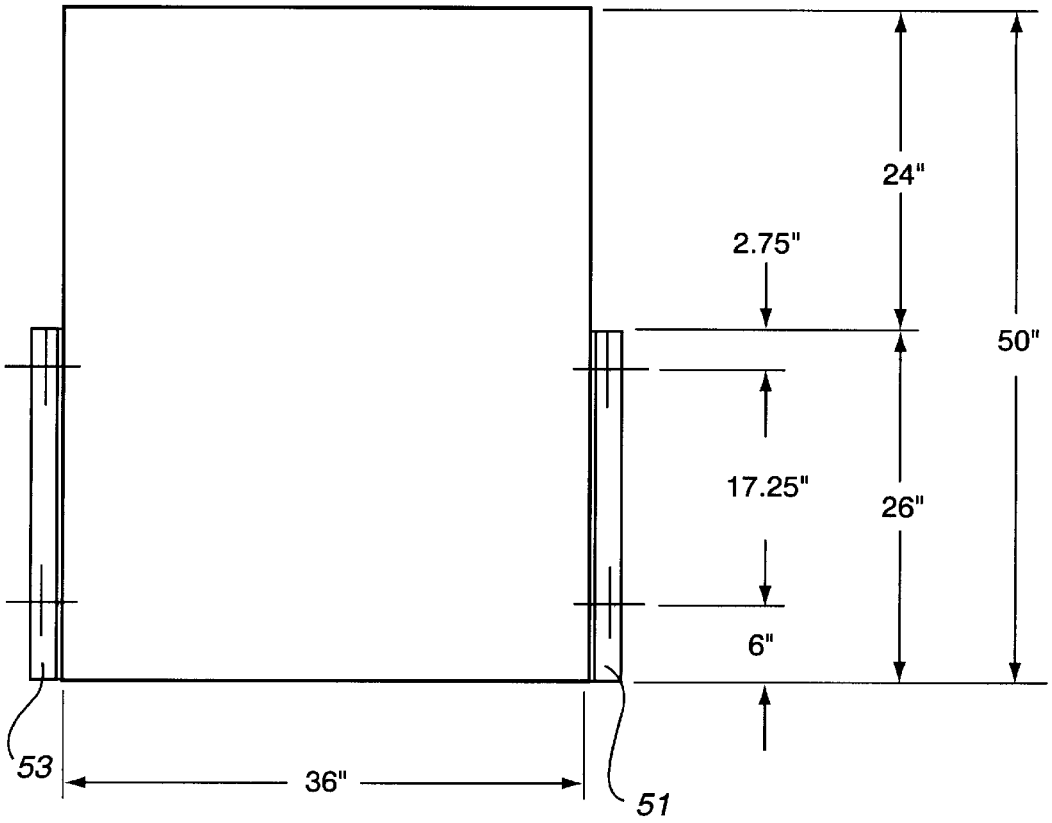
FIGS. 18, 19 and 20 are views of one half of the bottom section of the form of FIG. 4 whose two halves are identical.
Figure 19:
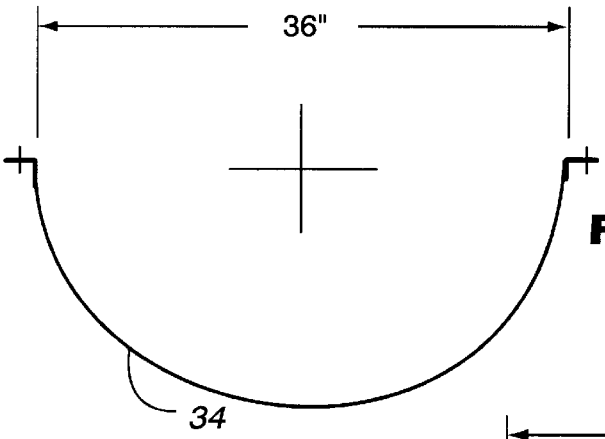
Figure 20:
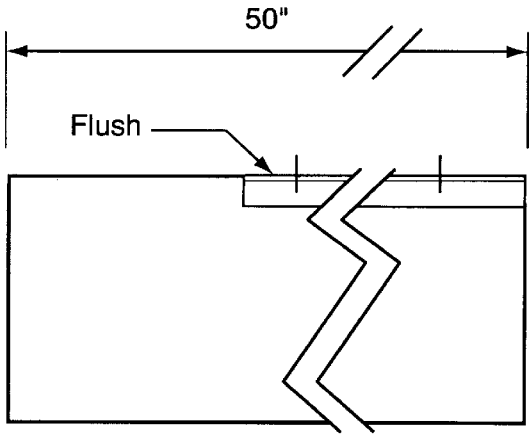

FIGS. 18 to 20 give the dimensions of the bottom section 34 and the angle irons 50, 51, 53 and 55 from which it can be seen that the angle irons are flush with the wall of the form.

Figure 21:
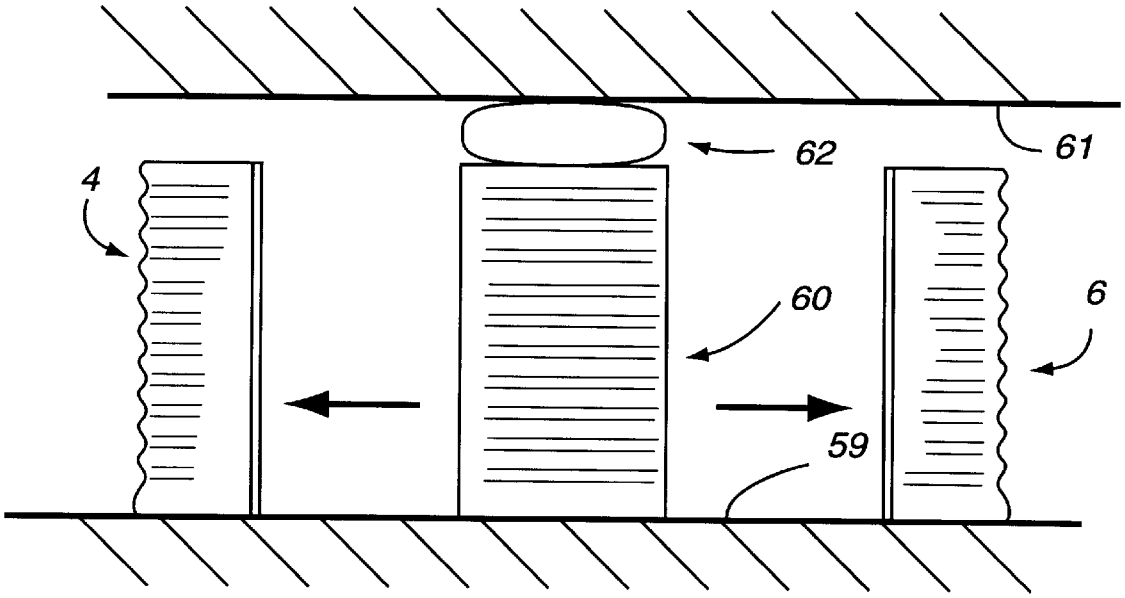
FIG. 21 is a schematic illustration of a mine support, in a coal mine, produced according to the invention.

The structures described above may be used in a method of installing a mine support in a coal mine, the support being removable by cutting with a coal shearer, the method comprising: (i) locating in a mine a form (e.g. 1) where it is desired to provide support for the mine, the form being composed of a plurality of engaging parts (e.g. 4, 6) shaped to produce a pillar 60 (see FIG. 21) when filled with a settable material, and the parts being disengageable to permit subsequent removal; (ii) filling the form (1) with a settable cementitous material, which when set is cuttable with a coal shearer, and allowing the material to set; and (iii) removing the form to provide a pillar 60 in the mine (supported on the mine floor 59—see FIG. 21) which is cuttable with a coal shearer. Often (i) and (ii) are practiced so that there is a gap between the top of the pillar 60 and the roof 61 of the mine; and then the method further comprises (iv) inserting a bag 62 (see FIG. 21) of yieldable grout in the gap. The method may further comprise (v) cutting through the pillar 60 and bag 62 of yieldable material and removing same, and (vi) reusing the parts (e.g. 4, 6) of the form after removal from the pillar 60 to make a second pillar.

In an exemplary (only) use of a form 1 approximately 4 feet in diameter, the form 1 is assembled at the point where the mine support is required and its height adjusted to leave a space at the top of the support for the installation of a bag 62 containing a yieldable support material. A bag (not shown) to receive the cementitious material is then inserted in the form. A mixture comprising 600 pounds/cubic yard of Type ½ Portland cement, 1600 pounds/cubic yard of Type F flyash and 833 pounds per cubic yard of water was pumped into the bag from the surface to fill the volume of the form. The cement flyash is allowed to set and it take the shape of the form. When set, the form 1 is dismantled and removed to expose the newly cast pillar approximately 10 feet in height. The minimum 28 day strength of the pillar is 2000 pounds per square inch. A bag 62 containing Tekset mixed with water is placed between the top of the pillar and the roof 61 of the mine and allowed to set. The form 1 is reassembled at a second location and used again.

When it is desired to remove the pillar 60 a coal shearer is used to cut through the bag 62 of yieldable grout and the cementitious pillar 60 both of which are then removed.

The advantages of the invention described in the above drawings are: (i) the mine support, being composed of flyash and cement, is readily cut through using a conventional coal cutting machine and is therefore easily removable when this is desired; (ii) the cement and flyash are inexpensive but can typically provide about 2,000 tons of roof support; (iii) the forms, being composed of overlapping sections, are adjustable to varying mine heights; (iv) the forms are readily removable; thereby permitting the cementitious pillar to be cut and the forms to be reused; (v) the cuttable mine supports are more quickly removed than the prior art methods involving a wooden crib; and (vi) the complete assembly of cementitious pillar and yieldable bag provides a high strength yet yieldable support.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of mining including installing a mine support in a mine, the support being removable by cutting a coal shearer, said method comprising:

(i) locating in a mine a form where it is desired to provide support for the mine, the form being composed of a plurality of engaging parts shaped to produce a pillar when filled with a settable material, and the parts being disengageable to permit subsequent removal;

(ii) filling the form with a settable cementitious material, which when set is cuttable with a coal shearer, and allowing the material to set;

wherein (i) and (ii) are practiced so that there is a gap between the top of the pillar and the roof of the mine;

(iii) removing the form to provide a pillar in the mine which is cuttable with a coal shearer; and (iv) inserting a bag of yieldable material in the gap.

2. A method as claimed in claim 1 further comprising (v) cutting through the pillar and bag of yieldable material and removing same.

3. A method as claimed in claim 2 wherein (i)–(iv) are practiced in a coal mine.

4. A method as claimed in claim 1 further comprising (vi) reusing the parts of the form after removal from the pillar to make a second pillar.

5. A method as claimed in claim 4 wherein (i)–(iv) and (vi) are practiced in a coal mine.

6. A method as claimed in claim 1 wherein (i)–(iv) are practiced in a coal mine.

* * * * *

UNITED STATES PATENT AND TRADEMARK OFFICE

CERTIFICATE OF CORRECTION

PATENT NO. : 6,196,635 B1
APPLICATION NO. : 09/249788
DATED : March 6, 2001
INVENTOR(S) : Rohaly et al.

It is certified that error appears in the above-identified patent and that said Letters Patent is hereby corrected as shown below:

Column 6, line 34 (claim 1, line 2), --with-- should be inserted after "cutting" and before "a" so that the phrase would read: --the support being removable by cutting with a coal shearer--

Signed and Sealed this

Thirty-first Day of July, 2007

JON W. DUDAS
*Director of the United States Patent and Trademark Office*